United States Patent [19]

Findeli

[11] 3,993,145

[45] Nov. 23, 1976

[54] POWER TOOL

[75] Inventor: Bernard Findeli, Plobsheim, France

[73] Assignee: Robert Bosch G.m.b.H., Stuttgart, Germany

[22] Filed: June 14, 1974

[21] Appl. No.: 479,492

[30] Foreign Application Priority Data

July 18, 1973 Germany ..... 2336477

[52] U.S. Cl. ..... 173/12; 192/150

[51] Int. Cl.[2] ..... B25D 23/145

[58] Field of Search ..... 173/12; 192/150

[56] References Cited

UNITED STATES PATENTS

| | | | |
|---|---|---|---|
| 3,289,715 | 12/1966 | De Groff et al. | 192/150 X |
| 3,319,753 | 5/1967 | Orwin et al. | 192/150 |
| 3,515,251 | 6/1970 | Clapp | 173/12 X |
| 3,612,236 | 10/1971 | Fernstrom et al. | 192/150 X |
| 3,724,560 | 4/1973 | Tibbott | 173/12 |
| 3,811,513 | 5/1974 | Wezel | 173/12 |

*Primary Examiner*—James A. Leppink
*Assistant Examiner*—William F. Pate
*Attorney, Agent, or Firm*—Michael J. Striker

[57] ABSTRACT

A power tool, particularly a power screwdriver, has a housing which accommodates a drive, and a tool holder which is rotatably mounted in the housing, together with a rotatable component that is connected with the drive to be rotated by the same. A coupling arrangement is provided, including cooperating coupling portions on the rotatable component and the tool holder, for connecting the tool holder with the rotatable component in torque-transmitting relationship, and for terminating such transmission of torque when the value of the latter exceeds a predetermined level.

9 Claims, 7 Drawing Figures

POWER TOOL

BACKGROUND OF THE INVENTION

The present invention relates generally to a tool, and more particularly to a power tool. Still more specifically, the present invention relates to a power tool in which a torque is transmitted from a drive to a tool holder, and in which the transmission or torque is automatically terminated when the torque level exceeds a predetermined value.

The prsent invention will be described hereafter with reference to a power screwdriver by way of example, but should be understood to be applicable to other power tools also.

Power tools, such as power screwdrivers, are already known in which an arrangement is provided for terminating the transmission of torque from the drive to the tool holder (e.g. the chuck holding the drive bit) when the torque acting between the drive and the tool holder exceeds a predetermined value. The prior art proposes a construction wherein the torque transmission takes place via a coupling having a coupling component which is movable axially in the housing of the tool in response to inward displacement of the tool holder which occurs when the housing with the tool accommodated in the tool holder is pressed against a workpiece, for instance a screw which is to be threaded in place. The movement of the coupling component is against the force of a biasing spring which becomes compressed until the axially movable coupling component engages a transverse pin or bolt in the housing. When a predetermined torque level is exceeded, e.g. when the screw has been fully threaded into a workpiece, the transverse bolt is shifted automatically and causes a disengagement of the axially displaceable coupling component with reference to the second component of the coupling, in that it permits an expansion of the heretofore compressed biasing spring.

This prior-art construction performs the desired interruption of the transmission of torque between the drive and the tool holder, but it is quite complicated in a structural sense and requires a relatively large amount of space. This means that the tool according to the prior art is expensive to produce and is rather bulky, the latter being in contradiction to the trend towards smaller and more readily handled tools.

SUMMARY OF THE INVENTION

Accordingly, it is a general object of the invention to provide an improved power tool of the type here in question, which avoids the disadvantages of the prior art.

More particularly, it is an object of the invention to provide such an improved power tool which is very simple in its construction, and therefore inexpensive.

An additional object of the invention is to provide such a power tool which can be constructed very compactly and which thus avoids the disadvantage of the prior art that required that such tools were bulky.

In keeping with the above objects, and with others which will become apparent hereafter, one feature of the invention resides in a power tool, particularly a power screwdriver, wherein the transmission of torque between a drive and a tool holder is automatically terminated when a predetermined torque value is exceeded. Briefly stated, the novel power tool comprises a housing accommodating a drive, and a tool holder which is rotatably mounted in this housing. A rotatable component is connected with the drive to be rotated by the same. Means is provided, including cooperating coupling portions on the rotatable component and on the tool holder, for connecting the tool holder with the rotatable component in torque-transmitting relationship, and for terminating the transmission when the torque exceeds a predetermined value.

A tool constructed in accordance with the present invention is inexpensive, because only simple components are required to couple the drive and the tool holder in torque-transmitting relationship, and to interrupt the transmission of torque. These components are simple and relatively inexpensive to produce, especially because they require little machining. The tool according to the present invention is very compact, but can nevertheless transmit high torque. Moreover, the wear of the components involved is low, because all forces are transmitted via spherical members. Still an additional advantage of the tool according to the present invention is the fact that, as will be discussed below, the value at which the transmission of the torque is terminated may be readily adjusted from the exterior of the tool to suit particular requirements of a user.

The novel features which are considered as characteristic for the invention are set forth in particular in the appended claims. The invention itself, however, both as to its construction and its method of operation together with additional objects and advantages thereof, will be best understood from the following description of specific embodiments when read in connection with the accompanying drawings.

DESCRIPTION OF THE PREFERRED EMBODIMENTS

Figure 1:
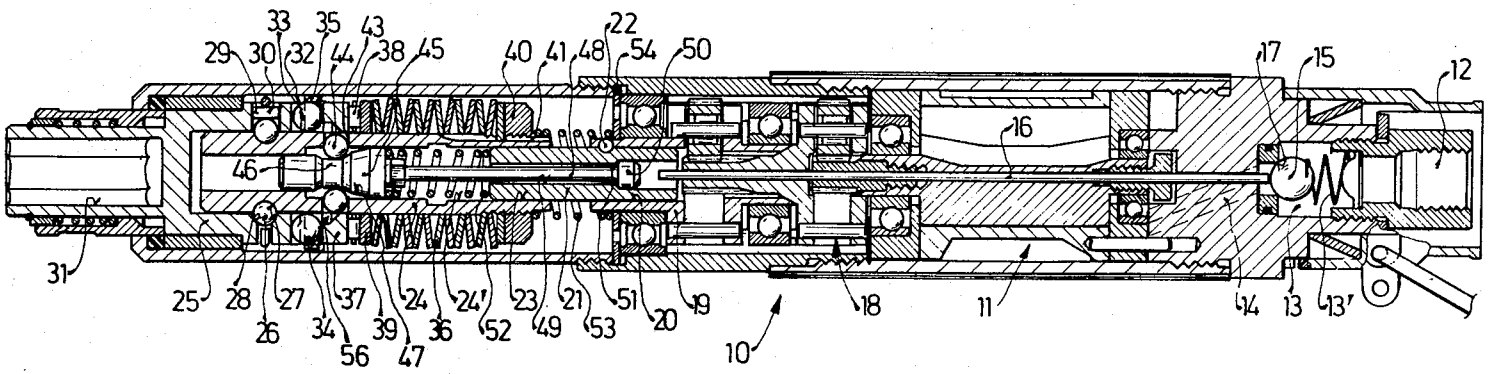
FIG. 1 is an axial section through a tool according to one embodiment of the invention.

The drawing illustrates two embodiments, one being shown in FIG. 1 and the other being shown in FIGS. 2–7. Discussing firstly the embodiment shown in FIG. 1, it will be seen that reference numeral 10 identifies a housing which, in the embodiment illustrated, is of several parts. The housing has a right-hand end and a left-hand end; the latter end is the one where the tool will be connected with the housing and which will face a workpiece. The right-hand end of the housing 10 accommodates an air motor 11 the construction and operation of which are already well known in the art, including the art of power tools, and which therefore requires no detailed discussion. The air motor 11 receives compressed air via an inlet nipple 12 provided with a valve 13 which has a valve member 15 that is urged by a valve spring 13' against its associated valve seat 17. When the valve member 15 is moved off the valve seat 17 against the action of the spring 13', by rightward displacement of a valve rod 16, then compressed air can pass from the nipple 12 through the bore 14 (shown in broken lines because invisible in the section of FIG. 1) to the air motor 11.

The air motor 11 constitutes a part of the drive, the remainder of which is constituted by a two-stage planetary gear 18 which is coupled with and driven by the air motor 11 and which transmits the torque produced by the latter to a planetary carrier 19. The carrier 19 is formed with a bore 20 which in the illustrated embodiment is of hexagonal cross-section and in which there is in part accommodated a jack shaft 21 of mating cross-section. The jack shaft 21 is retained against axial and rotational displacement relative to the planetary carrier 19 by means of a retaining ball 22 in the illustrated and conventional manner. The left-hand end of the jack shaft 21 extends into another bore 23 of hexagonal cross-section, which is formed in a sleeve 24 which latter thus has torque transmitted to it from the air motor 11.

At the left-hand end of the housing 10 there is mounted a tool holder 25; the end of the tool holder 25 which faces inwardly of the housing 10 is formed with a recess into which the sleeve 24 extends in part. The tool holder 25 is connected with the sleeve 24 against axial and rotational displacement relative to the same, for which purpose a plurality of ball members 26 are provided which are accommodated in semi-spherical depressions 27 in the outer circumference of the sleeve 24 and which extend in part into an inner circumferential groove 28 formed within the recess in the tool holder 25. The latter is also formed with a bore 29 communicating with its exterior surface and large enough to permit admission of the ball members 26 into the groove 28. This bore 29 is subsequently closed by a plug 30. At its end facing outwardly of the housing 10, the tool holder 25 is formed with a bore 31 of hexagonal cross-section into which the shaft of a tool (not illustrated) can be inserted so that the tool can be entrained in rotation by the tool holder 25 when the latter rotates.

Figure 6:
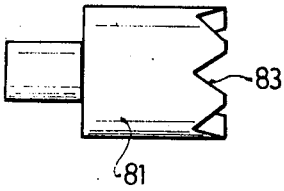
FIG. 6 is a side view of a component of the embodiment in FIG. 2.
Figure 7:
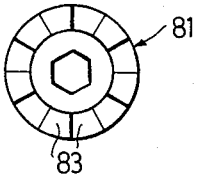
FIG. 7 is an end view of the component shown in FIG. 6, looking towards the left.

The axial end of the tool holder 25 which faces inwardly of the housing, i.e. towards the right in FIG. 1, is formed with a plurality of axial recesses which converge conically towards the left in FIG. 1 and are identified with reference numeral 32. Similar axial recesses are shown in FIGS. 6 and 7 with respect to the embodiment of FIG. 2, where they are designated with reference numeral 83. Reference may therefore be had to FIGS. 6 and 7 for a precise showing of the configuration of the recesses 32 of the embodiment of FIG. 1 also. Each of the recesses 32 receives a spherical coupling member 33. The latter are each received in an aperture 34, of which a plurality is formed in circumferentially spaced relationship in a flange 35 of the sleeve 24. The apertures 34 are large enough for the spherical members 33 to be readily movable in them. At the right-hand side of the flange 35 there is provided a pressure plate 37 which surrounds the sleeve 24 and which is pressed against the spherical members 33 by one or more expansion springs; in the embodiment of FIG. 1 a plurality of such springs 36 is utilized which are of the dished type, e.g. a Belleville spring. The inner periphery of the pressure plate 37 is formed with an annular groove 56 in the axial side which faces towards the flange 35. A radial bearing 38 and a plate 39 are interposed between the plate 37 and the springs 36. At the right-hand side the springs 36 bear against a nut 40 which is threaded onto a threaded portion 41 of the shaft 24. It will be appreciated that by threading the nut 40 towards the left or towards the right in FIG. 1, the pre-compression of the springs 36 can be varied and, as will be seen, this will result in an adjustment of the predetermined torque value at which transmission of torque from the drive to the tool holder 25 will automatically terminate.

The sleeve 24 is provided with a plurality of radial bores 43 which are located substantially midway between the opposite axial ends of the sleeve 24 and which each communicate with a stepped bore 24' extending axially through the center of the sleeve 24. Each of the radial bores 43 accommodates with slight play a ball 44. The stepped center bore 24' slidably accommodates a stepped plunger 45 one portion of which is formed with a cylindrical circumferential surface 46 and an axially adjacent portion of which is formed with a stepped conical circumferential surface 47. These surfaces 46 and 47 can be engaged by the balls 44. If the latter engage the surface 46, no part of the respective balls 44 extends beyond the outer circumference of the sleeve 24, as shown. A rod 48 is connected with the plunger 45 and extends into a stepped bore 49 of the jack shaft 21; the rod 48 has an enlarged head portion 50 which is located in an enlarged-diameter part of the stepped bore 49 where it can engage the shoulder 51. A spring 52 bears upon the plunger 45 and the jack shaft 21, permanently tending to displace the plunger 45 towards the left in FIG. 1. A further spring 53 bears upon the nut 40 and a plate 54 which separates the coupling components from the drive components of the construction, and which permanently tends to displace the coupling components towards the left in FIG. 1. In the normal position which is shown in FIG. 1, and in which the spherical coupling members 33 are received in the depressions 32, there is a certain spacing between the head portion 50 and the adjacent end of the valve rod 16, as illustrated. In this position, the valve member 15 is pressed against the seat 17 by the valve spring 13', so that no pressure fluid can pass to the air motor 11.

When the tool according to the present invention is to be used, for instance when a screw is to be threaded in place, then the bit engaged in the bore 31 of the tool holder 25 is pressed against the workpiece, such as the screw, by pushing the entire housing towards the left in FIG. 1. This causes the entire coupling arrangement, composed of the main components 21, 24 and 25 and their associated other elements, to move towards the right against the force of the spring 53. This, in turn, causes the head portion 50 of the rod 48 to press against the valve rod 16, displacing the latter towards the right and causing it to lift the valve member 15 off the seat 17. Compressed air can now flow from the inlet nipple 12 via the bore 14 to the air motor 11, causing the same to rotate. The rotation of the air motor is stepped down by the planetary gear 18 and its torque is transmitted to the planetary carrier 19 and from the same via the jack shaft 21 to the sleeve 24. The plate 37 presses the coupling members 33 into the depressions 32 under the biasing force of the springs 36, so that torque is being transmitted to the tool holder 25 and the latter is rotated.

As soon as the workpiece, such as a screw or a nut, is tightened and resists further turning so that the torque acting upon the tool holder 25 now increases to the predetermined value which is given by the precompression of the springs 36, i.e. by the biasing force exerted by the springs 36, the pressure plate 37 is displaced towards the right, counter to the biasing force of the springs 36, because the coupling members 33 now ride up the flanks bounding the depressions 32, since the latter are of the convergent shape shown in FIGS. 6 and 7. This displacement of the plate 37 towards the right now makes it possible for the balls 44 to shift in radially outward direction in their associated transverse bores. At the same time, the spring 52 can now displace the plunger 45 towards the left, since the balls 44 have the aforementioned freedom of outward movement, and as the balls ride on the conical surface 47 they are so displaced in radially outward direction until they enter into the annular recess 56. The leftward movement of the plunger 45 with its rod 48 and the head portion 50 thereof, means that the head portion 50 is retracted towards the left away from the valve rod 16 so that the latter now can slide again, and the valve rod 16 is now displaced towards the left by the valve member 15 as the latter is forced into sealing engagement with its valve seat 17 by the action of the valve spring 13'. This interrupts the supply of compressed air to the air motor 11, so that the latter comes to a halt.

The balls 44 maintain the pressure plate 37 in this displaced position which has just been described until the leftward pressure exerted by a user upon the entire tool — to urge the tool bit thereof into engagement with the workpiece — is terminated; when this takes place, the spring 53 displaces all of the components of the coupling arrangement towards the left, until they return to the position illustrated in FIG. 1. Of course, the air motor remains de-energized.

The torque level at which the transmission of torque to the tool holder 25 is terminated can be fixed, and for this purpose can be selected more or less at will by selecting the number and characteristics of the springs 36. It can also be made adjustable, simply by adjusting the pre-compression of the springs 36 by turning the nut 40 towards the left or towards the right in FIG. 1. A particular advantage of the construction in FIG. 1 is the fact that the pressure plate 37 is maintained in arrested position by the balls 44 when the supply of compressed air to the air motor 11 has been cut off and until the pressure exerted upon the tool to urge the same against the workpiece is released. Another advantage is the fact that the transmission of torque takes place via the spherical coupling members 33 and the balls 26, because this results in a particularly simple construction and a high resistance to wear of all components.

Figure 2:
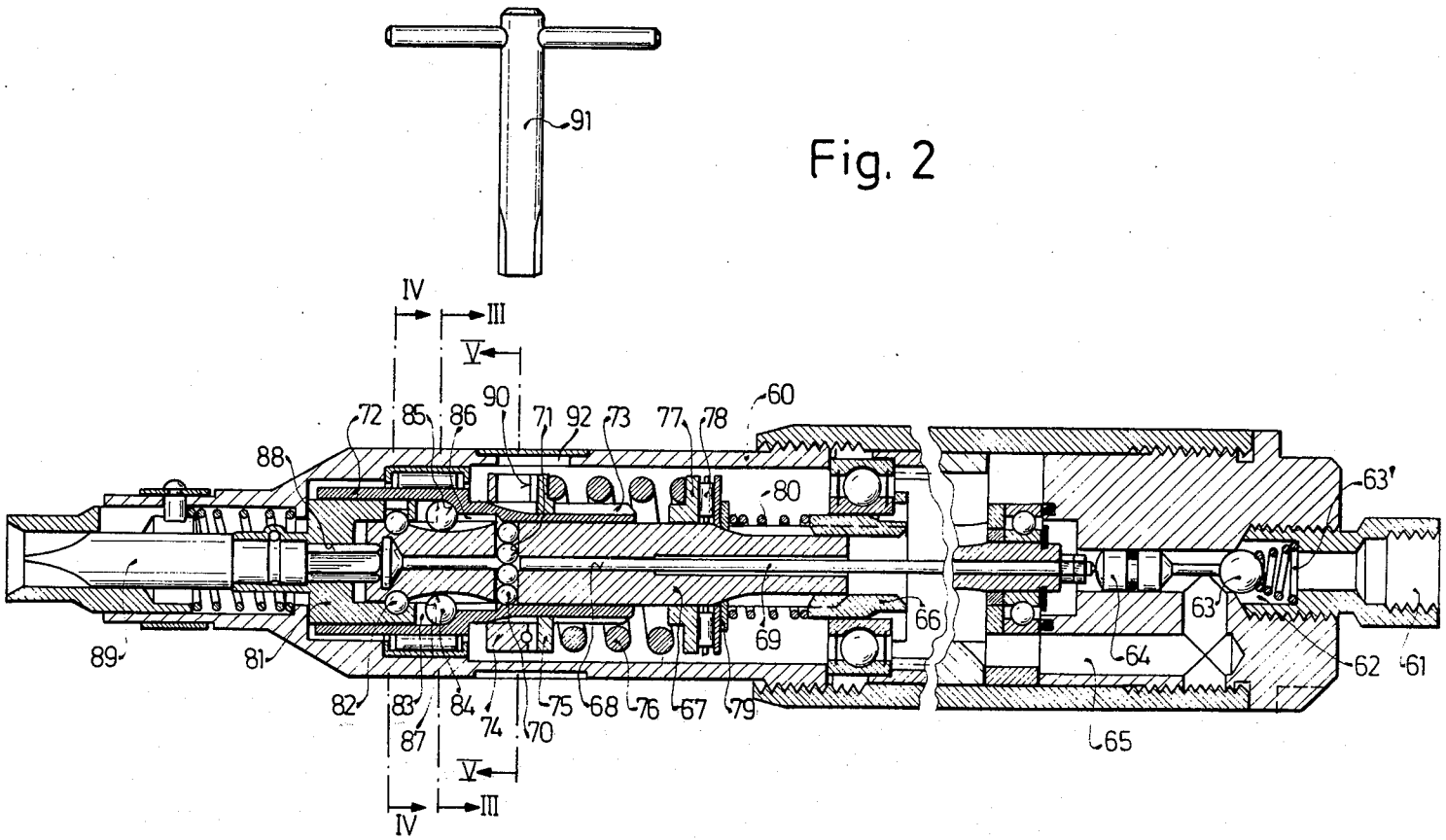
FIG. 2 is a view similar to FIG. 1, but illustrating a further embodiment of the invention.
Figure 3:
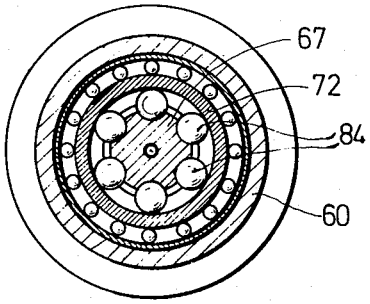
FIG. 3 is a section taken on line III—III of FIG. 2.
Figure 4:
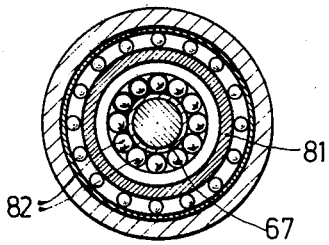
FIG. 4 is a section taken on line IV—IV of FIG. 2.
Figure 5:
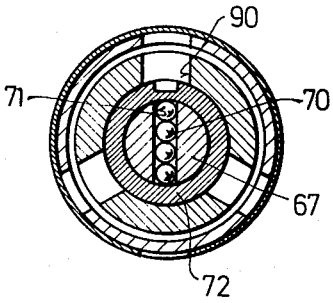
FIG. 5 is a section taken on line V—V of FIG. 2.

Coming now to the embodiment of FIG. 2, which is shown in an axial section in FIG. 2 itself, and details of which are shown in cross-section in FIGS. 3–5 and in a perspective view and an end view in FIGS. 6 and 7, respectively, it will be seen that this embodiment has a housing 60 that is again of several parts. The air motor and the planetary gear arrangement are not shown in this embodiment because they can be the same as in FIG. 1 and the duplication is therefore not necessary. The inlet nipple 61 for compressed air corresponds to the nipple 12 of FIG. 1 and is provided with a valve 62 the valve member 63 of which is pressed against the illustrated valve seat by the biasing force of a valve spring 63'. As in FIG. 1, the inlet nipple must of course be connected to any conventional source of compressed air.

In this embodiment, there is provided a plunger 64 which is accommodated in the illustrated bore and which can act upon the valve member 63 to displace it rightwardly away from its seat against the biasing force of the spring 63'. A bore 65 communicates the interior of the inlet nipple 61 with the (not illustrated) air motor when the valve member 63 is out of engagement with its associated valve seat. As before, the air motor drives the (also not illustrated) planetary gear having a planetary carrier 66 from which the torque received from the air motor is transmitted to a drive shaft 67. The latter is formed with a central bore 68 extending through it and slidably accommodating a valve rod 69. The right-hand end of the valve 69 is slightly spaced from the plunger 64 when the tool is in non-operative position, that is when it is in the position shown in FIG. 2. The left-hand end of the valve rod 68 cooperates with balls 70 which are accommodated in a transverse bore 71 that is also formed in the drive shaft 67 and intersects the longitudinal bore 68 (compare FIG. 5).

The drive shaft 67 is surrounded by a coupling sleeve 72 which is axially slidable on it and which, when it is in the illustrated position of FIG. 2, overlies with the smaller-diameter portion of its central passage the transverse bore 71 so as to prevent the balls 70 from moving radially in this bore. This means that the balls block any displacement of the valve rod 69 in direction towards the left in FIG. 2. The right-hand end portion of the coupling sleeve 72 is formed with an exterior screw thread 73 onto which is threaded a nut 74 to the right of which is located a plate 75. An expansion spring 76 bears upon the nut 74 via the plate 75, and at its right-hand end it bears upon a plate 77 which in turn is supported against a holding ring 79 mounted on the drive shaft 67, via a radial bearing 78. At the opposite axial side the ring 79 is engaged by an expansion spring 80 which also bears upon the planetary carrier 66.

In this embodiment, the tool holder is identified with reference numeral 81 and extends into the left-hand open end of the coupling sleeve 72, with which latter it is connected against axial displacement relative to the coupling sleeve 72 by means of balls 82 which each in part extend into an annular groove 67 formed in the inner circumferential surface of the drive shaft 67, and in part into a similar annular circumferential groove formed in the outer circumferential surface of the tool holder 81 (compare FIG. 4). As in the embodiment of FIG. 1, the embodiment of FIG. 2 provides a plurality of conical depressions 83 which are formed in the right-hand axial end of the tool holder 81 (compare FIGS. 6 and 7) and each of which receives a spherical coupling member 84 which also is engaged by an inclined annular shoulder 85 in the interior of the coupling sleeve 72. The inner circumference of the coupling sleeve 72 is further formed with a recess 86 the diameter of which is intermediate the diameter of the shoulder 85 and the smallest inner diameter of the coupling sleeve 72, so that when the recess 86 overlies the transverse bore 71, the balls 70 therein can move radially outwardly to a sufficient extent to free the central longitudinal bore 68. The spherical coupling members 84 are partially received in circumferentially distributed axially extending grooves 87 formed in the outer circumferential surface of the drive shaft 67. The tool holder 81 is formed with an internal hexagonal cross-section recess 88 into which a tool, such as the screwdriver bit 89 can be inserted. The nut 74 is formed with an annulus of teeth 90 which is accessible from the interior of the housing 60 through an opening 92 which can be closed by means of a cover as shown when not in use to prevent the entry of contaminants; a key 91 can be inserted through the opening 92 to mesh with the teeth 90 so that, when the key 91 is turned, the nut 74 is similarly turned, to thereby vary the pre-compression of the spring 76.

When the tool 79 is placed into engagement with the workpiece, and pressure is exerted upon the housing 60 towards the left in FIG. 2, then the tool holder 82 and the shaft 67 together with the associated components are displaced towards the right against the force of the spring 80. Since at this time the sleeve 72 is in such a position that the balls 70 cannot move radially outwardly in their bore 71, they press against the left-hand end of the valve rod 69, displacing the same towards the right and causing the valve member 63 to be lifted off its valve seat by the plunger 64. Compressed air can flow via the inlet nipple 61 and the bore 65 into the (not illustrated) compressed air motor, which it turns. The latter transmits torque via the (not illustrated) planetary drive to the planetary carrier 66, thereby stepping down the rpm of the motor. The planetary carrier 66 drives the shaft 67 in rotation, and since the shaft 67 is coupled with the tool holder 81 via the coupling members 84, the tool holder 81 and its associated tool are turned.

When the workpiece (e.g. a screw) has been threaded tight, and thus the torque acting upon the tool holder 81 exceeds the predetermined limit since the tool holder 81 now can no longer turn, the spherical coupling elements 84 will ride up on the inclined flanks of the conical depressions 83 (see FIG. 6) against the biasing force of the spring 76. In so doing, they act upon the shoulder 85 and displace the coupling sleeve 72 counter to the force of the spring 76 towards the right in FIG. 2. This unblocks the outer open end of the transverse bore 71 and the valve rod 69 can now push the balls 70 radially outwardly in the bore 71, so that the valve rod can move into the portion of the bore 86 which is located in FIG. 2 towards the left of the bore 71. In other words, the valve rod 69 can now yield in leftward direction in FIG. 2, thus releasing the force which it previously exerted upon the plunger 64, so that the latter and the valve member 63 can be moved towards the left by the force of the biasing spring 63', until the valve member 63 is in contact with its valve seat and terminates the supply of compressed air to the motor. The motor no longer turns and the balls 70 retain the coupling sleeve 72 in its displaced position. No torque is being transmitted any more and the motor is no longer energized.

This condition obtains until the power tool is retracted towards the right away from the workpiece, and in response to this release of the previously exerted leftward force the spring 80 now displaces the entire coupling arrangement together with the shaft 67 to the left-hand end position which is shown in FIG. 2, in which of course the motor remains de-engergized.

It is clear that the embodiment of FIG. 2 affords the same advantages as the one in FIG. 1 and meets the objects of the invention.

It will be understood that each of the elements described above, or two or more together, may also find a useful application in other types of constructions differing from the types described above.

While the invention has been illustrated and described as embodied in a power tool, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that from the standpoint of prior art fairly constitute essential characteristics of the generic or specific aspects of this invention and, therefore, such adaptations should and are intended to be comprehended within the meaning and range of equivalence of the following claims.

What is claimed as new and desired to be protected by Letters Patent in set forth in the appended claims:

1. A power tool, particularly a power screw driver, wherein the transmission between a drive and a tool holder is automatically terminated when a predetermined torque is exceeded, comprising a housing accommodating a drive, said drive comprising an air motor and a valve connecting said air motor with a source of compressed air and being movable to open position against a biasing force; a tool holder rotatably mounted in said housing; a rotatable component permanently connected with said drive to be rotated by the same, said rotatable component being formed with a transverse bore accommodating a plurality of ball members, and with a longitudinal bore intersecting said transverse bore; and means including coupling means for connecting said tool holder with said rotatable component in torque transmitting relationship and for terminating the transmission when the torque exceeds a predetermined value, said coupling means including a plurality of spherical coupling elements mounted on said rotatable component at fixed circumferentially spaced locations for rotation with said component, a plurality of circumferentially spaced axial recesses formed in an axial end of said tool holder which faces said coupling elements, and said connecting means includng further biasing means urging said coupling elements into respective ones of said recesses, a rod which holds said valve in open position when said torque is below said predetermined value, said rod being axially movable in said longitudinal bore of said rotating component in response to said torque exceeding said predetermined value so that said biasing force can move said valve to said closed position, a member surrounding said rotatable component and being formed with a stepped bore having a portion of larger and a portion of smaller diameter, said member being slidable axially of said rotatable component against the action of said biasing means from a position in which said smaller diameter portion of said bore surrounds said transverse bore and urges said ball members inwardly of the latter to block sliding of said valve rod, to a position in which said large diameter portion of said bore surrounds said transverse bore and said valve rod displaces said ball members radially outwardly of said transverse bore so as to be slidable in said longitudinal bore, said spherical coupling elements constituting the only drive connection between said component and said tool holder.

2. A power tool as defined in claim 1, wherein said rotatable component is a shaft formed in its outer circumferential surface with a plurality of circumferentially spaced axial grooves in each of which one of said coupling elements is partly received.

3. A power tool as defined in claim 1, wherein said member is a sleeve having an open end which faces and in part receives said tool holder.

4. A power tool as defined in claim 1, and further comprising spherical retaining members connecting said tool holder with said rotatable component against axial displacement relative to the same.

5. A power tool as defined in claim 1; and further comprising means for varying the biasing force exerted by said biasing means, and for thereby changing said predetermined value.

6. A power tool as defined in claim 1, wherein said biasing means comprises spring means.

7. A power tool, particularly a power screw driver, wherein the transmission of torque between a drive and a tool holder is automatically terminated when a predetermined torque is exceeded, comprising a housing accommodating a drive; a tool holder rotatably mounted in said housing; a rotatable component permanently connected with said drive to be rotated by the same, said rotatable component including a sleeve, a flange formed on said sleeve and being provided with a plurality of axial apertures, and a jack shaft connecting said sleeve with said drive; and means including coupling means for connecting said tool holder with said rotatable component in torque transmitting relationship, and for terminating the transmission when the torque exceeds a predetermined value, said coupling means including a plurality of spherical coupling elements respectively received in part in said axial apertures, said flange having an axial thickness which is smaller than the diameter of said coupling elements and said axial apertures penetrating said flange, a plurality of circumferentially spaced recesses formed in an axial end of said tool holder which faces said coupling elements, and biasing means urging said coupling elements into respective ones of said recesses, said spherical coupling elements constituting the only drive connection between said component and said tool holder, said means comprising further an annular plate surrounding said sleeve at an axial end of said flange which faces away from said axial recesses, said plate being pressed by said biasing means against said axial end of said flange, a plunger received and axially shiftable in said sleeve and having one portion provided with a cylindrical circumferential surface, and an axially adjacent portion provided with a conical circumferential surface, said sleeve being provided with a transverse bore, and spherical members which are received in said bore and which are located inwardly of the outer circumference of said sleeve when said one portion is located opposite said bore and located partially outwardly of said outer circumference of said sleeve when said axially adjacent portion is located opposite said bore, said annular plate having an inner annular recess into which said spherical elements enter when they are located partially outwardly of said outer circumference of said sleeve.

8. A power tool as defined in claim 7, wherein said drive includes an air-motor and a valve movable between an open and a closed position for connecting said air-motor with and disconnecting it from a source of compressed air; and further comprising rod means operatively associated with said plunger and with said valve for moving the latter to said open position in response to shifting of said plunger in one axial direction.

9. A power tool as defined in claim 7, wherein said biasing spring comprises at least one dished spring.

* * * * *